US010242611B2

(12) United States Patent
Kenmotsu et al.

(10) Patent No.: US 10,242,611 B2
(45) Date of Patent: Mar. 26, 2019

(54) DISPLAY DEVICE FOR DETECTING AN ERROR IN SCAN LINES AND DRIVING METHOD THEREOF

(71) Applicant: SAMSUNG DISPLAY CO., LTD., Yongin-si, Gyeonggi-do (KR)

(72) Inventors: Akihiro Kenmotsu, Hwaseong-si (KR); Junghak Kim, Hwaseong-si (KR); Juneyoung Song, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 0 days.

(21) Appl. No.: 15/468,203

(22) Filed: Mar. 24, 2017

(65) Prior Publication Data

US 2017/0309209 A1 Oct. 26, 2017

(30) Foreign Application Priority Data

Apr. 25, 2016 (KR) ..... 10-2016-0050341

(51) Int. Cl.

| | |
|---|---|
| ***G09G 3/00*** | (2006.01) |
| ***G09G 3/3266*** | (2016.01) |
| ***G09G 3/3291*** | (2016.01) |
| ***G09G 3/3233*** | (2016.01) |

(52) U.S. Cl.

CPC ..... *G09G 3/006* (2013.01); *G09G 3/3233* (2013.01); *G09G 3/3266* (2013.01); *G09G 3/3291* (2013.01); *G09G 2300/0809* (2013.01); *G09G 2300/0819* (2013.01); *G09G 2300/0852* (2013.01); *G09G 2300/0861* (2013.01); *G09G 2300/0866* (2013.01); *G09G 2320/0295* (2013.01); *G09G 2330/021* (2013.01); *G09G 2330/04* (2013.01); *G09G 2330/10* (2013.01)

(58) Field of Classification Search

CPC ..... G09G 3/006
USPC ..... 345/690, 77
See application file for complete search history.

(56) References Cited

U.S. PATENT DOCUMENTS

| | | | | |
|---|---|---|---|---|
| 2008/0192032 | A1* | 8/2008 | Park | G09G 3/3677 345/204 |
| 2011/0148954 | A1* | 6/2011 | Tobita | G09G 3/3688 345/698 |
| 2013/0201171 | A1* | 8/2013 | Song | G09G 3/20 345/212 |
| 2014/0118409 | A1 | 5/2014 | Jun et al. | |
| 2015/0026506 | A1* | 1/2015 | Lee | G06F 11/0706 714/3 |

FOREIGN PATENT DOCUMENTS

| | | | |
|---|---|---|---|
| KR | 10-2011-0023846 | A | 3/2011 |
| KR | 10-2013-0061596 | A | 6/2013 |

(Continued)

*Primary Examiner* — Long D Pham
(74) *Attorney, Agent, or Firm* — Lee & Morse, P.C.

(57) ABSTRACT

A display panel includes a plurality of scan lines that receive scan signals, a plurality of data lines that receive data signals, lines that receive masking signals according to the scan signals, and a plurality of pixels respectively connected to the plurality of scan lines and the plurality of data lines. The error detection circuit receives the scan signals that are transmitted through the plurality of scan lines, and outputs an error detection signal based on the scan signals. Power is not supplied to the plurality of pixels when the error detection signal is at an activated level.

20 Claims, 13 Drawing Sheets

(56) References Cited

FOREIGN PATENT DOCUMENTS

| | | | |
|---|---|---|---|
| KR | 10-2013-0070206 | A | 6/2013 |
| KR | 10-2014-0039829 | A | 4/2014 |
| KR | 10-2014-0141189 | A | 12/2014 |
| KR | 10-2014-0141276 | A | 12/2014 |
| KR | 10-2015-0079247 | A | 7/2015 |

* cited by examiner

DISPLAY DEVICE FOR DETECTING AN ERROR IN SCAN LINES AND DRIVING METHOD THEREOF

CROSS-REFERENCE TO RELATED APPLICATION

Korean Patent Application No. 10-2016-0050341, filed on Apr. 25, 2016, in the Korean Intellectual Property Office, and entitled: "Display Device and Driving Method Thereof," is incorporated by reference herein in its entirety.

BACKGROUND

1. Field

The present disclosure herein relates to a display device and a driving method thereof, and more particularly, to a display device including an organic light-emitting diode (OLED) and a driving method thereof.

2. Description of the Related Art

An organic electroluminescence (EL) display device, one of display devices, displays an image by using an organic EL device (for example, OLED) that emits light by the recombination of electrons and holes. Since the organic EL display device is self-luminous and does not need an additional backlight unit, the organic EL display device is advantageous in terms of power consumption and has an excellent response time, viewing angle, contrast ratio, etc.

The organic EL device includes an anode, a cathode, and an organic light-emitting layer disposed therebetween. Electrons injected from the cathode and holes injected from the anode are recombined in the organic light-emitting layer to generate exitons, and the exitons emit light upon releasing energy. The organic light-emitting layer has a multilayer structure including an emission layer (EML), an electron transport layer (ETL), and a hole transport layer (HTL) in order to improve light-emitting efficiency by enhancing an electron/hole balance. The organic light-emitting layer may additionally include an electron injection layer (EIL), and an hole injection layer (HIL).

The organic EL device is driven by using power voltages ELVDD and ELVSS in addition to a pixel voltage according to an image signal. Accordingly, voltage lines or electrodes where these voltages are applied are provided in an organic EL display panel.

When the organic EL display panel is damaged due to an external pressure, and the like, a short circuit may be caused among a voltage line, a scan line, and a data line where the pixel voltage is applied, and thus an overcurrent may occur between a power supply circuit that provides the power voltages ELVDD and ELVSS and the organic EL display panel. The overcurrent may thus damage the organic EL display panel, and for example, the overcurrent may cause the organic EL display panel to be burnt.

SUMMARY

One or more embodiments provides a display device which includes a display panel having a plurality of scan lines to receive scan signals, plurality of data lines to receive data signals, and a plurality of pixels respectively connected to the plurality of scan lines and the plurality of data lines, and an error detection circuit to receive the scan signals transmitted through the plurality of scan lines, and to output an error detection signal based on the scan signals. Power is not supplied to the plurality of pixels when the error detection signal is at an activated level.

The error detection circuit may output the error detection signal based on the scan signals during light-emitting periods of the plurality of pixels.

The may include a scan driving circuit to provide the scan signals for the plurality of scan lines, wherein the scan driving circuit is electrically connected to one end of each of the plurality of scan lines, and the error detection circuit is electrically connected to the other end of each of the plurality of scan lines.

The scan driving circuit may provide the plurality of scan lines with the scan signals including a test pattern during the light-emitting periods of the plurality of pixels.

The scan signals may be a pulse signal with a predetermined frequency during the light-emitting periods of the plurality of pixels.

The scan signals may be pulse signals which are sequentially activated during the light-emitting periods of the plurality of pixels.

The error detection circuit may compare each of the scan signals with a reference voltage, and may activate the error detection signal depending on the comparison result.

The scan driving circuit and the error detection circuit may face each other with the display panel therebetween.

The scan signals may be pulse signals which are sequentially activated during the scan periods of the plurality of pixels.

The may include a plurality of masking lines corresponding to and extending parallel to each scan line, wherein the error detection circuit is to receive the masking signals transmitted through the plurality of masking lines, and output the error detection signal based on at least one of the scan signals or the masking signals.

Each of the masking signals may have a level complementary to the level of a corresponding scan signal among the scan signals during the light-emitting periods.

Each of the plurality of pixels may include a first transistor connected between a corresponding data line among the plurality of data lines and a first node, and having a gate electrode connected to a corresponding scan signal among the scan signals, a second transistor connected between the first node and a second node, and having a gate electrode connected to a corresponding masking signal among the masking signals, and a light-emitting circuit to receive a first power voltage and a second power voltage, and to emit light according to a voltage level of the first node.

The light-emitting circuit may include a first capacitor connected between the first power voltage and the second node, a second capacitor connected between the second node and a third node, a third transistor connected between the first power voltage and a fourth node, and having a gate electrode connected to the third node; and an organic light-emitting diode connected between the fourth node and the second power voltage.

The light-emitting circuit may include a fourth transistor connected between the third node and the fourth node, and having a gate electrode connected to a compensation signal.

The error detection circuit compares a sum of the scan signal and the masking signal corresponding to each other with the reference voltage, and activates the error detection signal depending on the comparison result.

The error detection circuit may output the error detection signal based on the masking signals during light-emitting periods of the plurality of pixels.

A driving method for a display device including a plurality of pixels connected to scan lines, the driving method including providing the scan lines with scan signals and/or masking lines with masking signals according to the scan signals, comparing at least one of the scan signals or the masking signals with a reference voltage, and activating an error detection signal based on the comparison result.

The scan signals provided for the plurality of scan lines may be a pulse signal with a predetermined frequency.

The scan signals provided for the plurality of scan lines may be sequentially activated.

The masking lines may be connected to the pixels, and activating the error detection signal may include comparing a sum of the scan signal and the masking signal corresponding to each other with the reference voltage, and activating the error detection signal depending on the comparison result.

Activating the error detection signal may include dividing the scan signals into a plurality of scan signal groups, comparing a sum of the voltages of each of the plurality of scan signal groups with the reference voltage, and activating the error detection signal depending on the comparison result.

The driving method may further include stopping power supply to the pixels when the error detection signal is activated.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
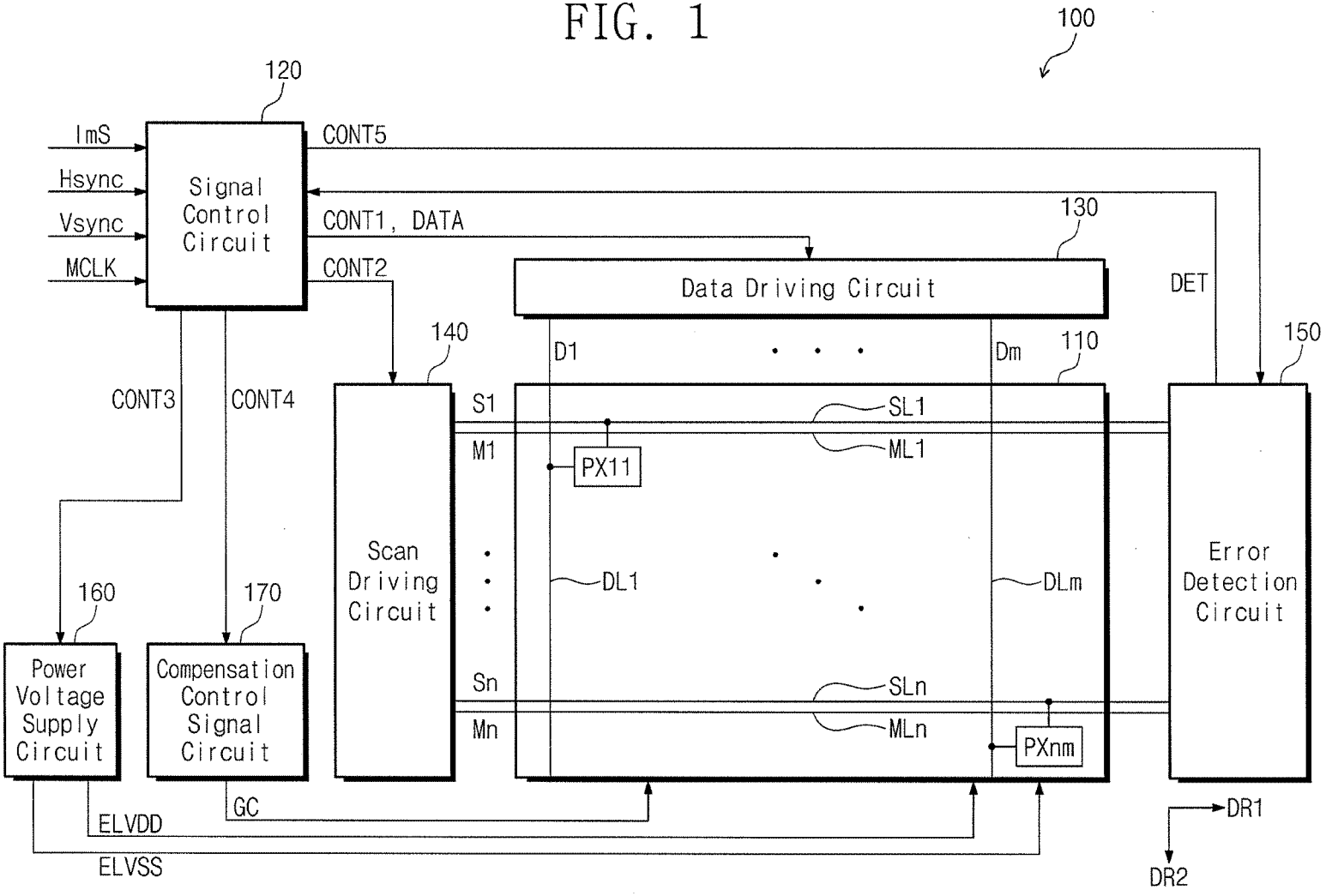
FIG. 1 illustrates a block diagram of a display device according to an embodiment.

FIG. 1 is a block diagram illustrating a display device according to an embodiment. Referring to FIG. 1, a display device 100 includes a display panel 110, a signal control circuit 120, a data driving circuit 130, a scan driving circuit 140, an error detection circuit 150, a power voltage supply circuit 160, and a compensation control signal circuit 170.

The display panel 110 includes a plurality of scan lines SL1 to SLn, a plurality of data lines DL1 to DLm crossing the plurality of scan lines, and a plurality of pixels PX11 to PXnm in regions in which the plurality of scan lines and the plurality of data lines cross each other. The plurality of scan lines SL1 to SLn extend in a first direction DR1 from the scan driving circuit 140, and are sequentially disposed in parallel in a second direction DR2. The plurality of data lines DL1 to DLm extend in the second direction DR2 from the data driving circuit 130, and are sequentially disposed in parallel in the first direction DR1. The plurality of scan lines SL1 to SLn and the plurality of data lines DL1 to DLm are insulated from each other. A plurality of masking lines ML1 to MLn correspond respectively to the plurality of scan lines SL1 to SLn. Each of the plurality of masking lines ML1 to MLn is disposed adjacent to a corresponding scan line of the plurality of scan lines SL1 to SLn. Each of the plurality of pixels PX11 to PXnm receives, from the power voltage supply circuit 160, a first power voltage ELVDD and a second power voltage ELVSS. Each of the plurality of pixels PX11 to PXnm receives a compensation signal GC from the compensation control signal circuit 170.

The signal control circuit 120 receives image information ImS input from the outside and input control signals for controlling a display of the image information. The input control signal may include a horizontal synchronization signal Hsync, a vertical synchronization signal Vsync, and a main clock signal MCLK. The signal control circuit 120 outputs a first control signal CONT1 and an image data signal DATA which control the data driving circuit 130, a second control signal CONT2 for controlling the scan driving circuit 140, a third control signal CONT3 for controlling the power voltage supply circuit 160, a fourth control signal CONT4 for controlling the compensation control signal circuit 170, and a fifth control signal CONT5 for controlling the error detection circuit 150.

The data driving circuit 130 outputs data signals D1 to Dm to drive the plurality of data lines DL1 to DLm in response to the first control signal CONT1 and the image data signal DATA from the signal control circuit 120.

The scan driving circuit 140 outputs scan signals S1 to Sn for driving the plurality of scan lines SL1 to SLn and masking signals M1 to Mn for driving the plurality of masking lines ML1 to MLn, in response to the second control signal CONT2 from the signal control circuit 120.

The error detection circuit 150 detects whether the display panel 110 is damaged, based on the scan signals S1 to Sn transmitted through the plurality of scan lines SL1 to SLn and the masking signals M1 to Mn transmitted through the plurality of masking lines ML1 to MLn, and outputs an error detection signal DET corresponding to the detection result. The error detection signal DET may be provided to the signal control circuit 120. The error detection circuit 150 may output the error detection signal DET based on either of the scan signals S1 to Sn or the masking signals M1 to Mn.

The power voltage supply circuit 160 supplies the first power voltage ELVDD and the second power voltage ELVSS required for the operation of the display panel 110, in response to the third control signal CONT3 from the signal control circuit 120.

The compensation control signal circuit 170 outputs the compensation signal GC in response to the fourth control signal CONT4 from the signal control circuit 120.

Figure 2:
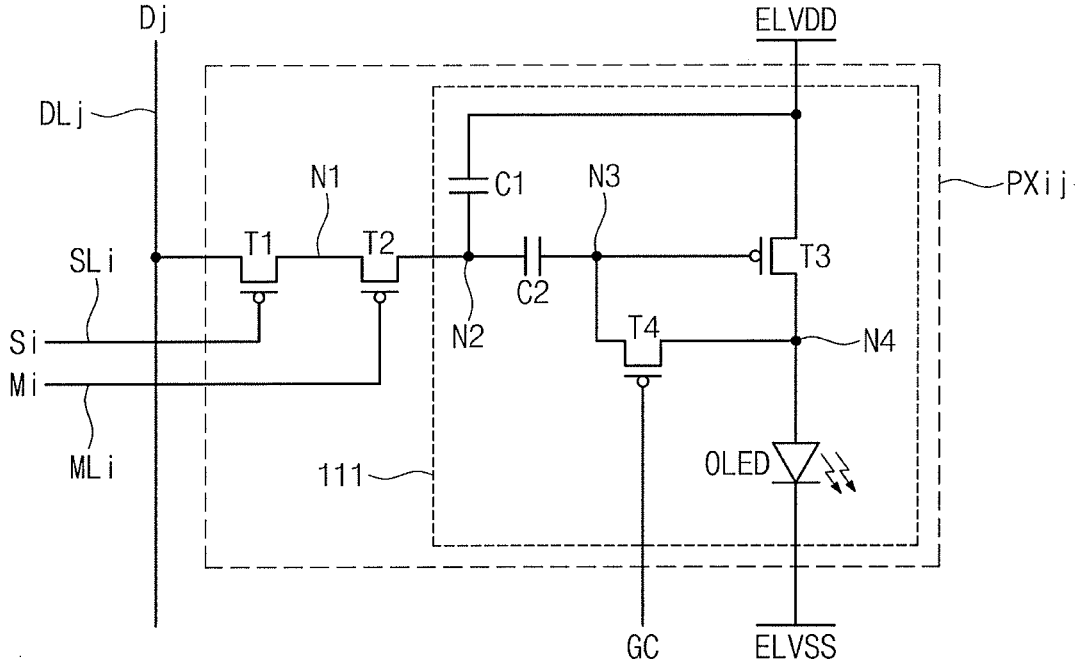
FIG. 2 illustrates a pixel configuration provided for the display panel shown in FIG. 1, according to an embodiment.

FIG. 2 illustrates a pixel configuration provided for the display panel shown in FIG. 1, according to an embodiment. Referring to FIGS. 1 and 2, a pixel PXij is connected to an i-th gate line GLi and a j-th data line DLj. The pixel PXij includes a first transistor T1, a second transistor T2, and a light-emitting circuit 111. The light-emitting circuit 111 includes a third transistor T3, a fourth transistor T4, a first capacitor C1, a second capacitor C2, and an organic light-emitting diode (OLED).

The first transistor T1 is connected between the j-th data line DLj and a first node N1, and has a gate electrode connected to an i-th scan signal Si. The second transistor T2 is connected between the first node N1 and a second node N2, and has a gate electrode connected to an i-th masking signal Mi.

The first capacitor C1 is connected between the first power voltage ELVDD and the second node N2. The second capacitor C2 is connected between the second node N2 and a third node N3. The third transistor T3 is connected between the first power voltage ELVDD and a fourth node N4, and has a gate electrode connected to the third node N3. The fourth transistor T4 is connected between the third node N3 and the fourth node N4, and includes a gate electrode connected to the compensation signal GC. The OLED has an anode terminal connected to the fourth node N4, and a cathode terminal connected to the second power voltage ELVSS.

Figure 3:
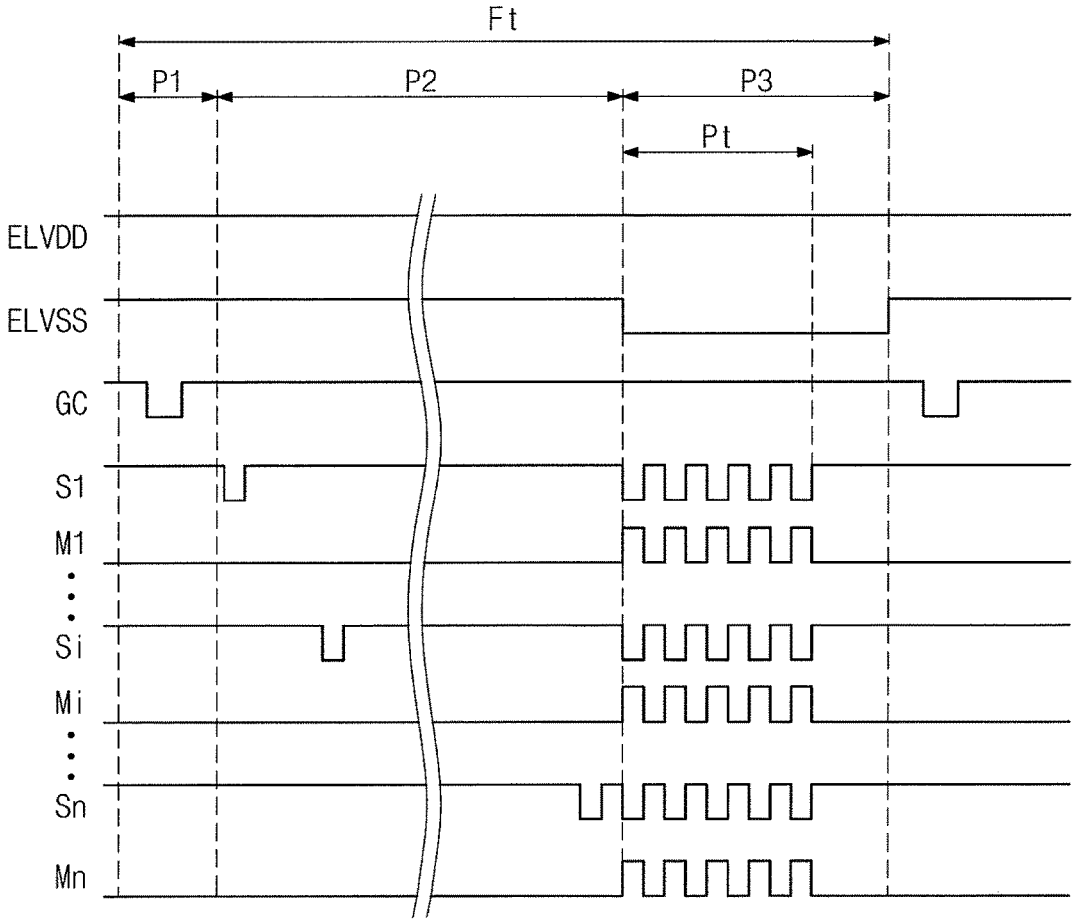
FIG. 3 illustrates a timing diagram of, by way of example, an operation of the display device shown in FIG. 1.

FIG. 3 is a timing diagram illustrating, by way of example, an operation of the display device illustrated in FIG. 1. Referring to FIGS. 1 to 3, a frame Ft during which an image is displayed on the display panel 110 includes a compensation period P1, a scan period P2, and a light-emitting period P3.

When the compensation signal GC transitions to a low level during the compensation period P1, the fourth transistor T4 is turned on, so that the third node N3 and the fourth node N4 are connected. In this case, by adjusting the voltage levels of the first power voltage ELVDD and the second power voltage ELVSS, the voltages of the third node N3 and the fourth node N4 may be reset to predetermined voltages. In other words, the threshold voltage of the third transistor T3 may be compensated by setting, to predetermined voltages, respective voltages of the gate electrode, a source electrode, and a drain electrode of the third transistor T3.

The scan signals S1 to Sn transition sequentially to a low level during the scan period P2. The masking signals M1 to Mn are maintained at a low level during the scan period P2. The second transistor T2 may maintain a turn-on state while the i-th masking signal Mi is at a low level. When the i-th scan signal Si transitions to the low level, the first transistor T1 is turned on, so that the i-th data signal Di transmitted through the i-th data line DLi is stored in the first capacitor C1 and the second capacitor C2.

When the second power voltage ELVSS transitions to a low level during the light-emitting period P3, the OLED may emit light due to the voltages stored in the first capacitor C1 and the second capacitor C2.

During a predetermined test period Pt within the light-emitting period P3, the scan signals S1 to Sn transition to a high level and to a low level with a predetermined cycle. During the light-emitting period P3, the scan driving circuit 140 outputs the masking signals M1 to Mn, which have levels complementary to those of the scan signals S1 to Sn. For example, when the i-th scan signal Si transitions to the low level, the i-th masking signal Mi transitions to the high level. Accordingly, even when the scan signal Si transitions to the low level during the light-emitting period P3, the data signal Dj received through the data line DLj may be prevented from being transmitted to the second node N2.

The test period Pt may be equal to or shorter than the light-emitting period P3. The error detection circuit 150 illustrated in FIG. 1 outputs the error detection signal DET based on the scan signals S1 to Sn and the masking signals M1 to Mn during the test period Pt within the light-emitting period P3.

Figure 4:
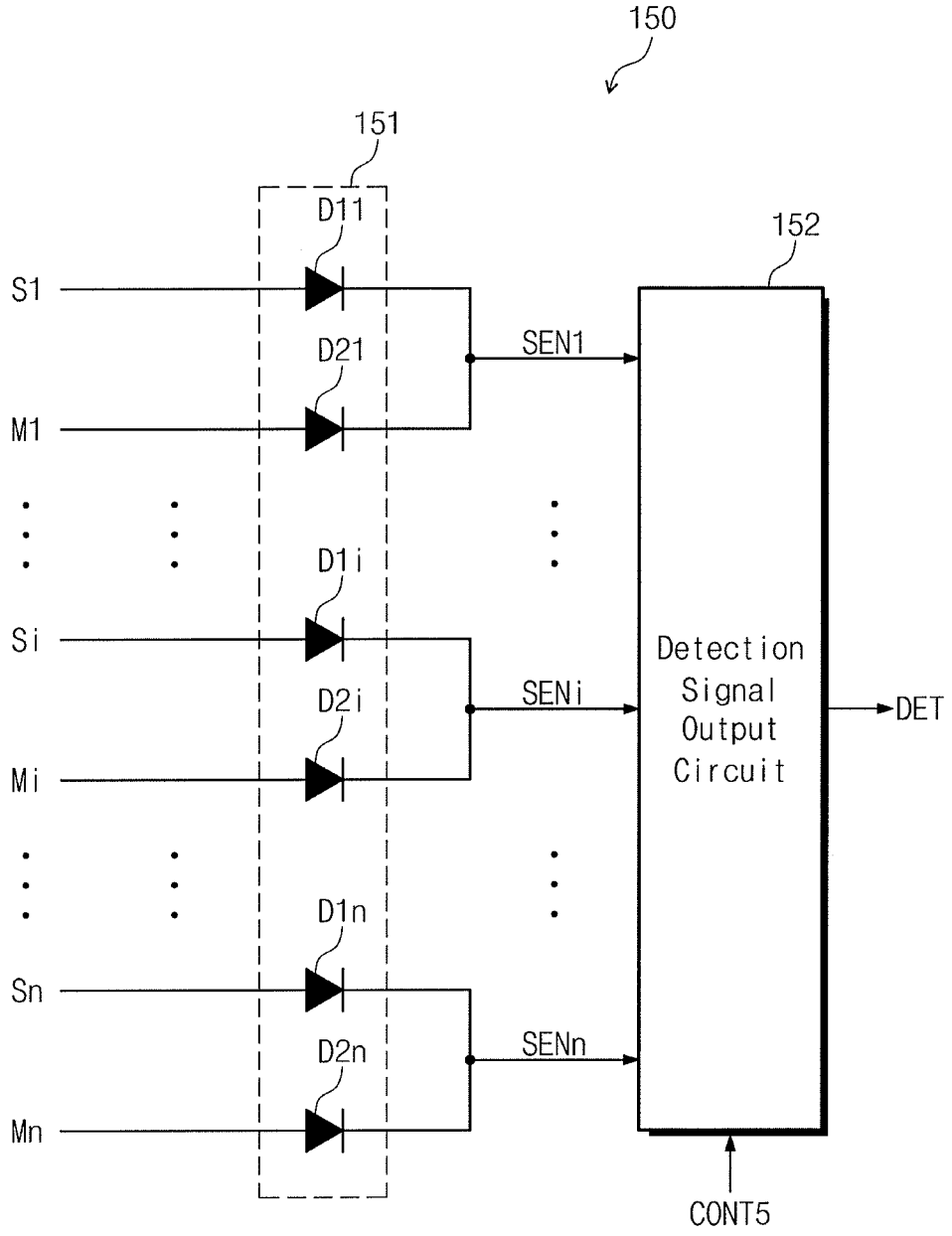
FIG. 4 illustrates, by way of example, a configuration of an error detection circuit shown in FIG. 1, according to an embodiment.

FIG. 4 illustrates, by way of example, a configuration of an error detection circuit shown in FIG. 1, according to an embodiment. Referring to FIGS. 1 and 4, the error detection circuit 150 includes a detecting circuit 151 and a detection signal output circuit 152.

The detecting circuit 151 receives the scan signals S1 to Sn and masking signals M1 to Mn, and outputs detection signals SEN1 to SENn. The detection signal output circuit 152 outputs the error detection signal DET in response to the detection signals SEN1 to SENn when the fifth control signal CONT5 indicates the test period Pt.

More specifically, the detecting circuit 151 includes diodes D11 to D1*n* respectively connected to the scan signals S1 to Sn, and diodes D21 to D2*n* respectively connected to the masking signals M1 to Mn. The diodes D11 to Dln and the diodes D21 to D2*n* correspond to each other. Outputs of a pair of corresponding diodes among the diodes D11 to D1*n* and the diodes D21 to D2*n* are summed up and output as the detection signals SEN1 to SENn. For example, the outputs of the diodes D11 and D21 are summed up and output as the detection signal SEN1. The outputs of the diodes D1*i* and D2*i* are summed up and output as the detection signal SENi. The outputs of the diodes D1*n* and D2*n* are summed up and output as the detection signal SENn. The detection signal output circuit 152 deactivates the error detection signal DET to a low level when all the voltages of the detection signals SEN1 to SENn are higher than the reference voltage VREF1. The detection signal output circuit 152 activates the error detection signal DET to a high level when at least one of the voltages of the detection signals SEN1 to SENn is lower than the reference voltage VREF1.

Figure 5:
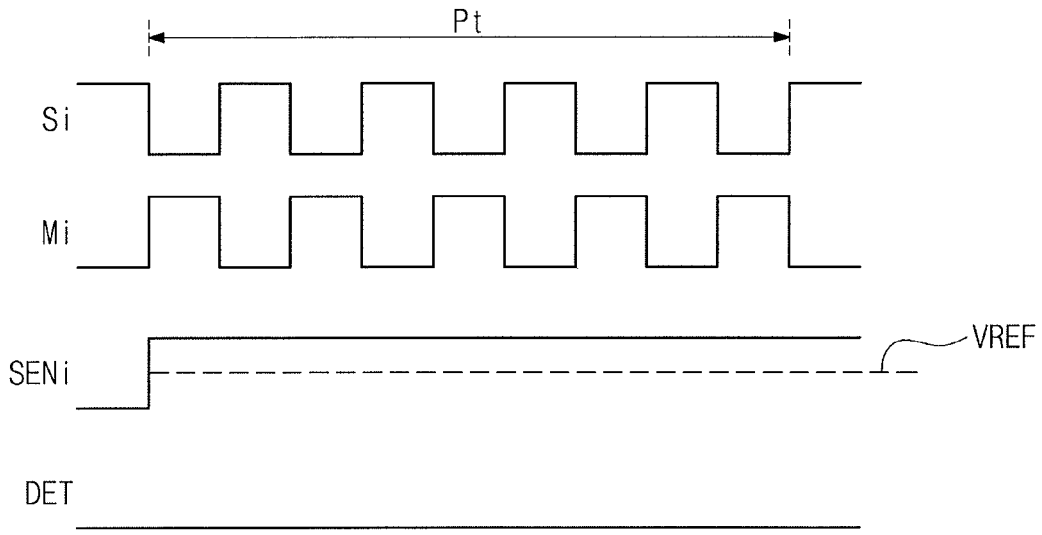
FIGS. 5 and 6 illustrate timing diagrams of the operation of the error detection circuit shown in FIG. 4.
Figure 6:
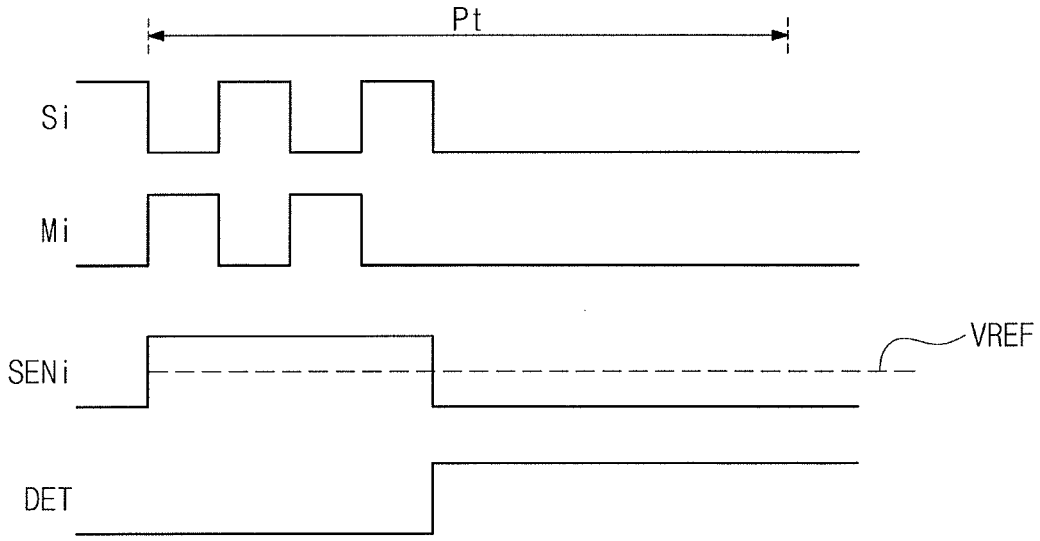

FIGS. 5 and 6 are timing diagrams illustrating the operation of the error detection circuit illustrated in FIG. 4.

Referring to FIGS. 1, 4, and 5, the waveforms of the i-th scan signal Si and the i-th masking signal Mi corresponding to the i-th scan signal Si have a complementary relationship during the test period Pt when the pixels PX11 to PXnm and the scan lines SL1 to SLn of the display panel 110 are not damaged. Accordingly, the i-th detection signal SENi output from the detecting circuit 151 is maintained higher than the predetermined reference voltage VREF1. The detection signal output circuit 152 outputs the error detection signal DET having a low level since the i-th detection signal SENi has a level higher than the predetermined reference voltage VREF1.

Referring to FIGS. 1, 4, and 6, the waveforms of the i-th scan signal Si and the i-th masking signal Mi corresponding to the i-th scan signal Si do not have a complementary relationship during the test period Pt when at least one of the pixels PX11 to PXnm or the scan lines S1 to Sn of the display panel 110 is damaged. In this case, the i-th detection signal SENi output from the detecting circuit 151 is maintained lower than the predetermined reference voltage VREF1. The detection signal output circuit 152 outputs the error detection signal DET having a high level since the i-th detection signal SENi has a level lower than the predetermined reference voltage VREF1.

In response to the error detection signal DET at the high level, the signal control circuit 120 outputs the third control signal CONT3 such that the power voltage supply circuit 160 does not generate the first power voltage ELVDD and the second power voltage ELVSS. An operation of the display panel 110 is stopped when the power voltage supply circuit 160 does not generate the first power voltage ELVDD and the second power voltage ELVSS. Therefore, the display device 100 is protected against risks such as fire by preventing an overcurrent caused by a short circuit of the signal lines in the display panel 110.

Figure 7:
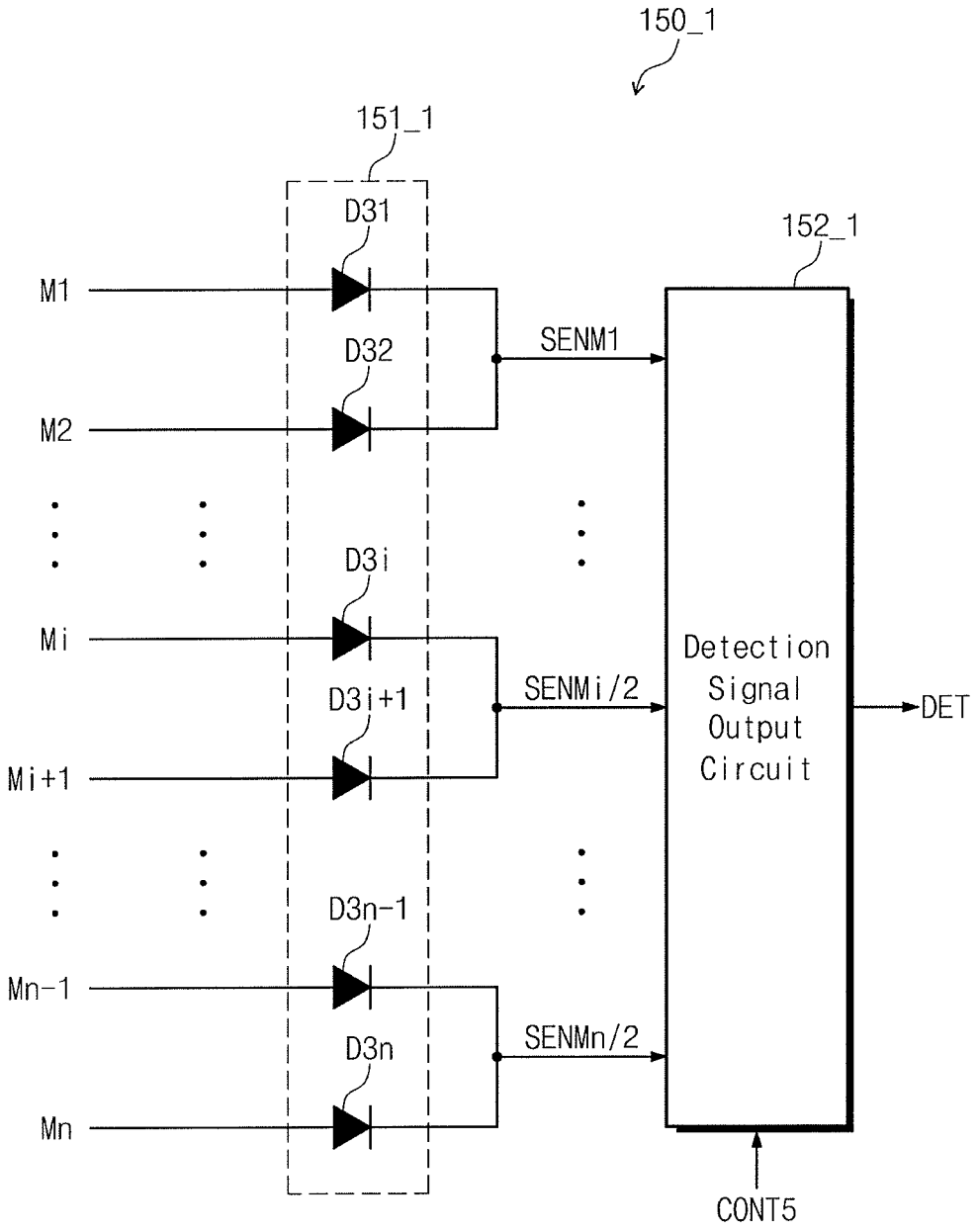
FIG. 7 illustrates a configuration of the error detection circuit shown in FIG. 1, according to another embodiment.

FIG. 7 illustrates a configuration of the error detection circuit shown in FIG. 1, according to another embodiment. Referring to FIGS. 1 and 7, an error detection circuit 150_1 includes a detecting circuit 151_1 and a detection signal output circuit 152_1.

The detecting circuit 151_1 receives the masking signals M1 to Mn, and outputs detection signals SENM1 to SENMn/2. The detection signal output circuit 152_1 outputs the error detection signal DET in response to the detection signals SENM1 to SENMn/2 when the fifth control signal CONT5 indicates the test period Pt.

More specifically, the detecting circuit 151_1 includes diodes D31 to D3*n* respectively connected to the masking signals M1 to Mn. Outputs of a pair of adjacent diodes of the diodes D31 to D3*n* are summed up and output as the detection signals SENM1 to SENMn/2. For example, the outputs of the diodes D31 and D32 are summed up and output as the detection signal SENM1. The outputs of the diodes D3*i* and D3*i*+1 are summed up and output as the detection signal SENMi/2. The outputs of the diodes D3*n*−1 and D3*n* are summed up and output as the detection signal SENMn/2. The detection signal output circuit 152_1 deactivates the error detection signal DET to a low level when all the voltages of the detection signals SENM1 to SENMn/2 are higher than a reference voltage VREF2. The detection signal output circuit 152_1 activates the error detection signal DET to a high level when at least one of the voltages of the detection signals SENM1 to SENMn/2 is lower than the reference voltage VREF2.

Figure 8:
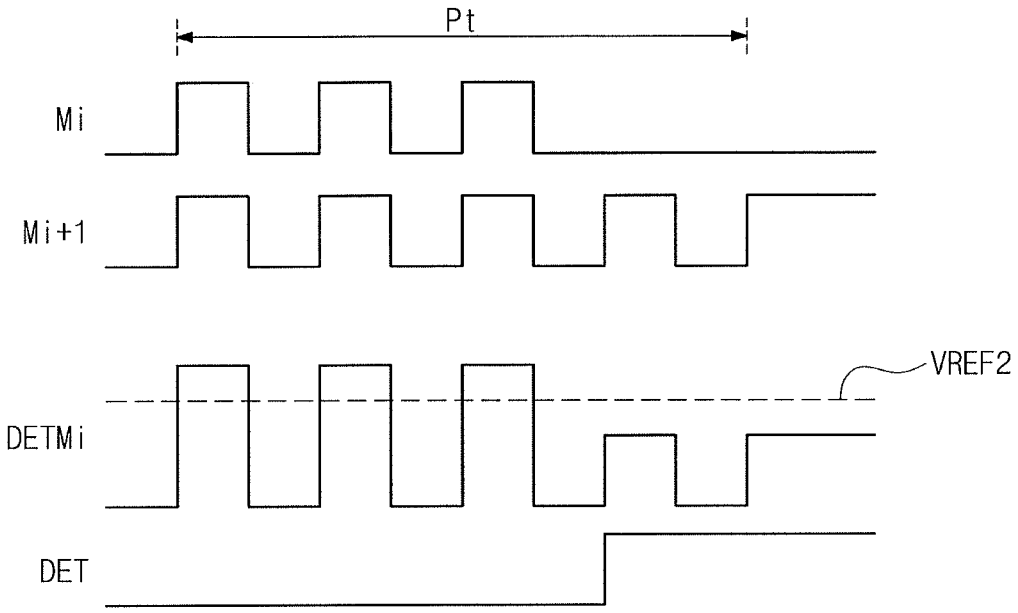
FIG. 8 illustrates a timing diagram of an operation of the error detection circuit shown in FIG. 7.

FIG. 8 is a timing diagram illustrating an operation of the error detection circuit illustrated in FIG. 7.

Referring to FIGS. 1, 7, and 8, the i-th masking signal Mi and the (i+1)-th masking signal Mi+1 have the same waveform during the test period Pt when the pixels PX11 to PXnm and the masking lines ML1 to MLn of the display panel 110 are not damaged. Accordingly, the (i/2)-th detection signal SENMi/2 output from the detecting circuit 151_1 is maintained higher than the predetermined reference voltage VREF2. The i-th masking signal Mi is maintained at the low level when at least one of the i-th masking line MLi or the pixels PXi1 to PXim connected to the i-th masking line MLi is damaged. In this case, the detection signal output circuit 152_1 outputs the error detection signal DET having a high level since the (i/2)-th detection signal SENMi/2 has a level lower than the predetermined reference voltage VREF2.

Figure 9:
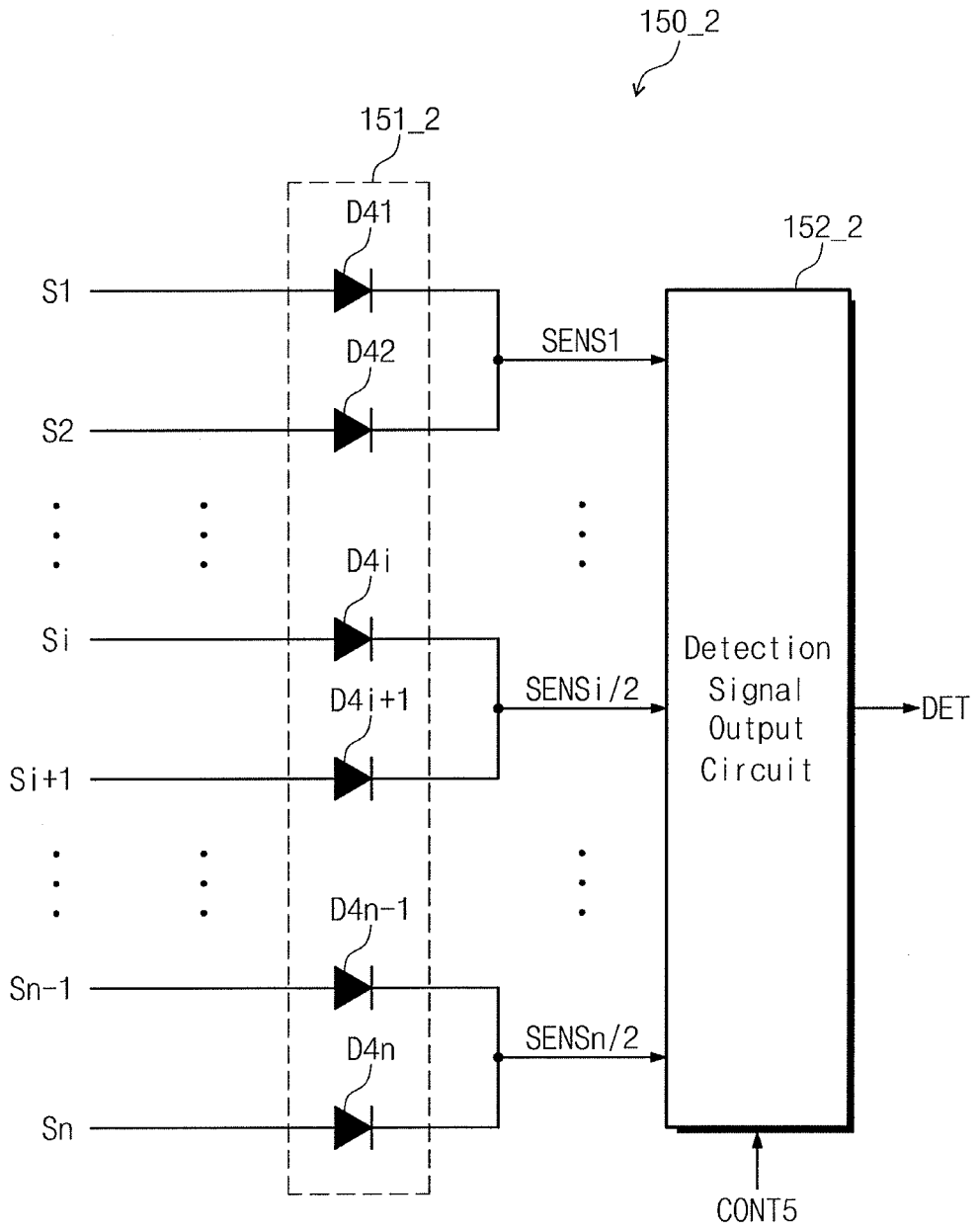
FIG. 9 illustrates a configuration of the error detection circuit shown in FIG. 1, according to another embodiment.

FIG. 9 illustrates a configuration of the error detection circuit shown in FIG. 1, according to another embodiment. Referring to FIGS. 1 and 9, an error detection circuit 150_2 includes a detecting circuit 151_2 and a detection signal output circuit 152_2.

The detecting circuit 151_2 receives the scan signals S1 to Sn, and outputs detection signals SENS1 to SENSn/2. The detection signal output circuit 152_2 outputs the error detection signal DET in response to the detection signals SENS1 to SENSn/2 when the fifth control signal CONT5 indicates the test period Pt.

More specifically, the detecting circuit 151_2 includes diodes D41 to D4*n* respectively connected to the scan signals S1 to Sn. Outputs of a pair of adjacent diodes of the diodes D41 to D4*n* are summed up and output as the detection signals SENS1 to SENSn/2. For example, the outputs of the diodes D41 and D42 are summed up and output as the detection signal SENS1. The outputs of the diodes D4*i* and D4*i*+1 are summed up and output as the detection signal SENSi/2. The outputs of the diodes D4*n*-1 and D4*n* are summed up and output as the detection signal SENSn12. The detection signal output circuit 152_2 deactivates the error detection signal DET to a low level when every voltage of the detection signals SENS1 to SENSn/2 is higher than a reference voltage VREF3. The detection signal output circuit 152_2 activates the error detection signal DET to a high level when at least one of the voltages of the detection signals SENS1 to SENSn/2 is lower than the reference voltage VREF3.

Figure 10:
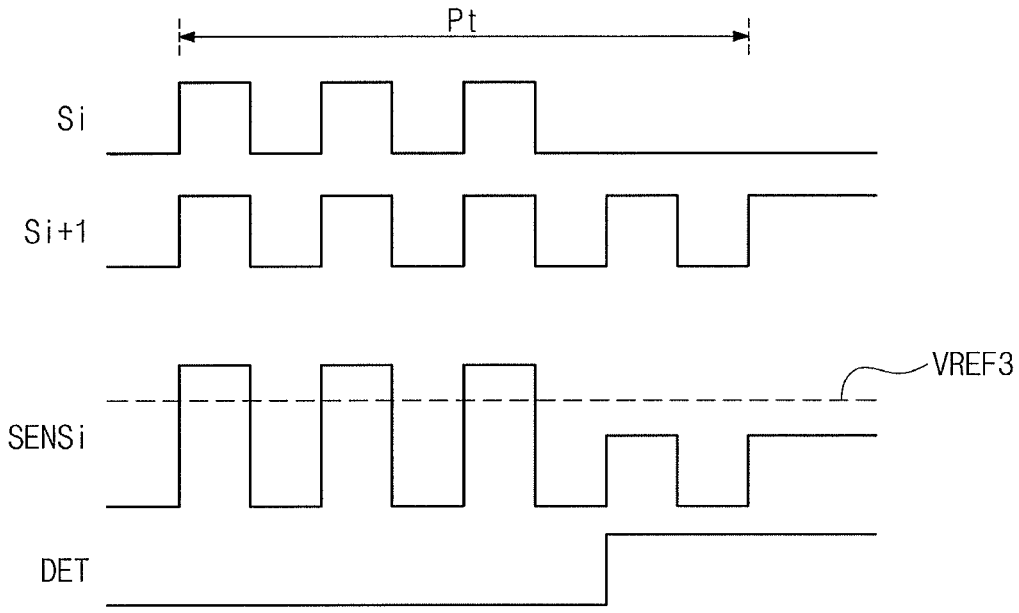
FIG. 10 illustrates a timing diagram of an operation of the error detection circuit illustrated in FIG. 9.

FIG. 10 is a timing diagram illustrating an operation of the error detection circuit illustrated in FIG. 9.

Referring to FIGS. 1, 9, and 10, the i-th scan signal Si and the (i+1)-th scan signal Si+1 have the same waveform during the test period Pt when the pixels PX11 to PXnm and the scan lines SL1 to SLn of the display panel 110 are not damaged. Accordingly, the (i/2)-th detection signal SENSi/2 output from the detecting circuit 151_2 is maintained higher than the predetermined reference voltage VREF3. The i-th scan signal Si is maintained at a low level when at least one of the i-th scan line SLi or the pixels PXi1 to PXim connected to the i-th scan line SLi is damaged. In this case, the detection signal output circuit 152_2 outputs the error detection signal DET having a high level since the (i/2)-th detection signal SENSi/2 has a level lower than the predetermined reference voltage VREF3.

When the error detection circuit 150_2 detects the damage of the display panel 110, the pixel PXij illustrated in FIG. 2 may not include the second transistor T2 and the display 110 in FIG. 1 may not include the masking lines ML1 to MLn.

Figure 11:
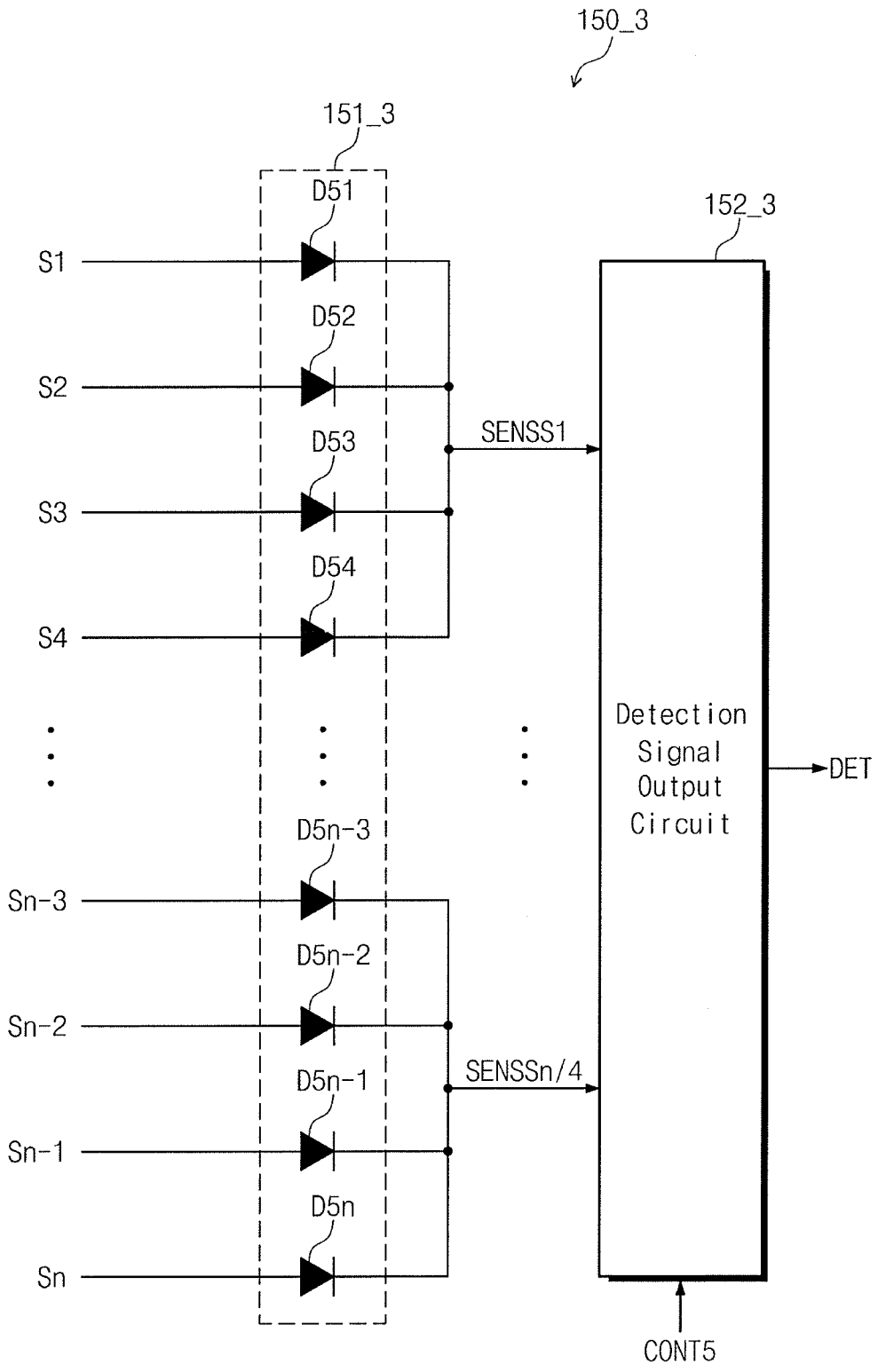
FIG. 11 illustrates a configuration of the error detection circuit of in FIG. 1, according to another embodiment.

FIG. 11 illustrates a configuration of the error detection circuit shown in FIG. 1, according to another embodiment. Referring to FIGS. 1 and 11, an error detection circuit 150_3 includes a detecting circuit 151_3 and a detection signal output circuit 152_3.

The detecting circuit 151_3 receives the scan signals S1 to Sn, and outputs detection signals SENSS1 to SENSSn/4. The detection signal output circuit 152_3 outputs the error detection signal DET in response to the detection signals SENSS1 to SENSSn/4 when the fifth control signal CONT5 indicates the test period Pt.

More specifically, the detecting circuit 151_3 includes diodes D51 to D5*n* respectively connected to the scan signals S1 to Sn. Outputs of adjacent four diodes of the diodes D51 to D5*n* are summed up and output as the detection signals SENSS1 to SENSSn/4. For example, the outputs of the diodes D51, D52, D53, and D54 are summed up and output as the detection signal SENSS1. The outputs of the diodes D5*n*-3, D5*n*-2, D5*n*-1, and D5*n* are summed up and output as the detection signal SENSSn/4. The detection signal output circuit 152_3 deactivates the error detection signal DET to a low level when all the voltages of the detection signals SENSS1 to SENSSn/4 are higher than a reference voltage VREF4. The detection signal output circuit 152_3 activates the error detection signal DET to a high level when at least one of the voltages of the detection signals SENSS1 to SENSSn/4 is lower than the reference voltage VREF4.

Figure 12:
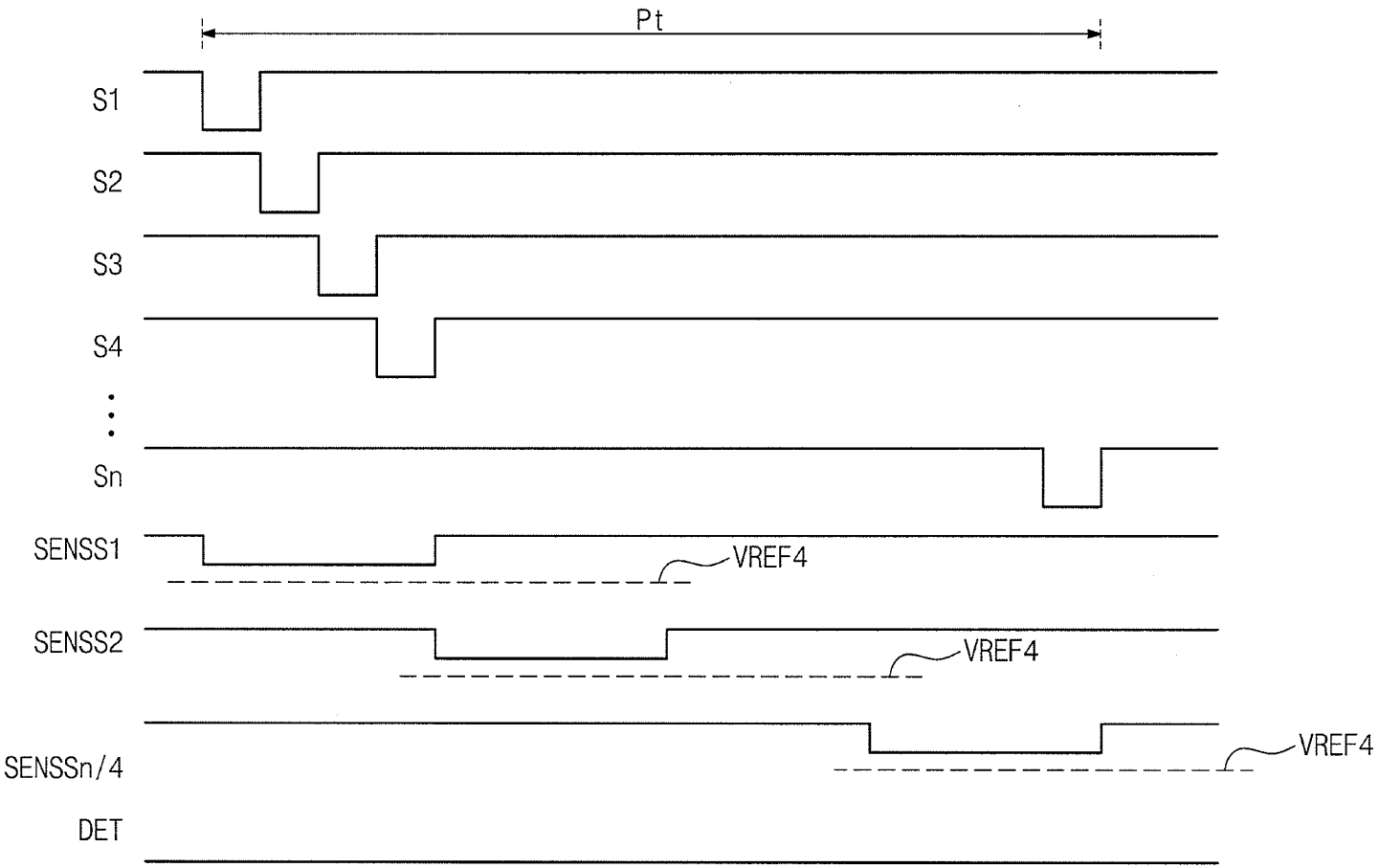
FIG. 12 illustrates a timing diagram of an operation of the error detection circuit shown in FIG. 11.

FIG. 12 is a timing diagram illustrating an operation of the error detection circuit illustrated in FIG. 11.

Referring to FIGS. 1, 11, and 12, the scan driving circuit 140 provide the scan lines SL1 to SLn with the scan signals S1 to Sn that transition sequentially to a low level during the test period Pt. The voltage of the detection signal SENSS1, which is a sum of the scan signals S1, S2, S3, and S4, is maintained higher than the predetermined reference voltage VREF4 when the pixels PX11 to PXnm and the scan lines SL1 to SLn of the display panel 110 are not damaged. Accordingly, the detection signal output circuit 152_3 outputs the error detection signal DET having a low level.

The voltage of the detection signal SENSS1, which is the sum of the scan signals S1, S2, S3, and S4, becomes lower than the predetermined reference voltage VREF4 due to a leakage current when at least one of the pixels connected to the scan lines SL1 to SL4 or the scan lines SL1 to SL4 is damaged. In this case, the detection signal output circuit 152_3 outputs the error detection signal DET having a high level.

Figure 13:
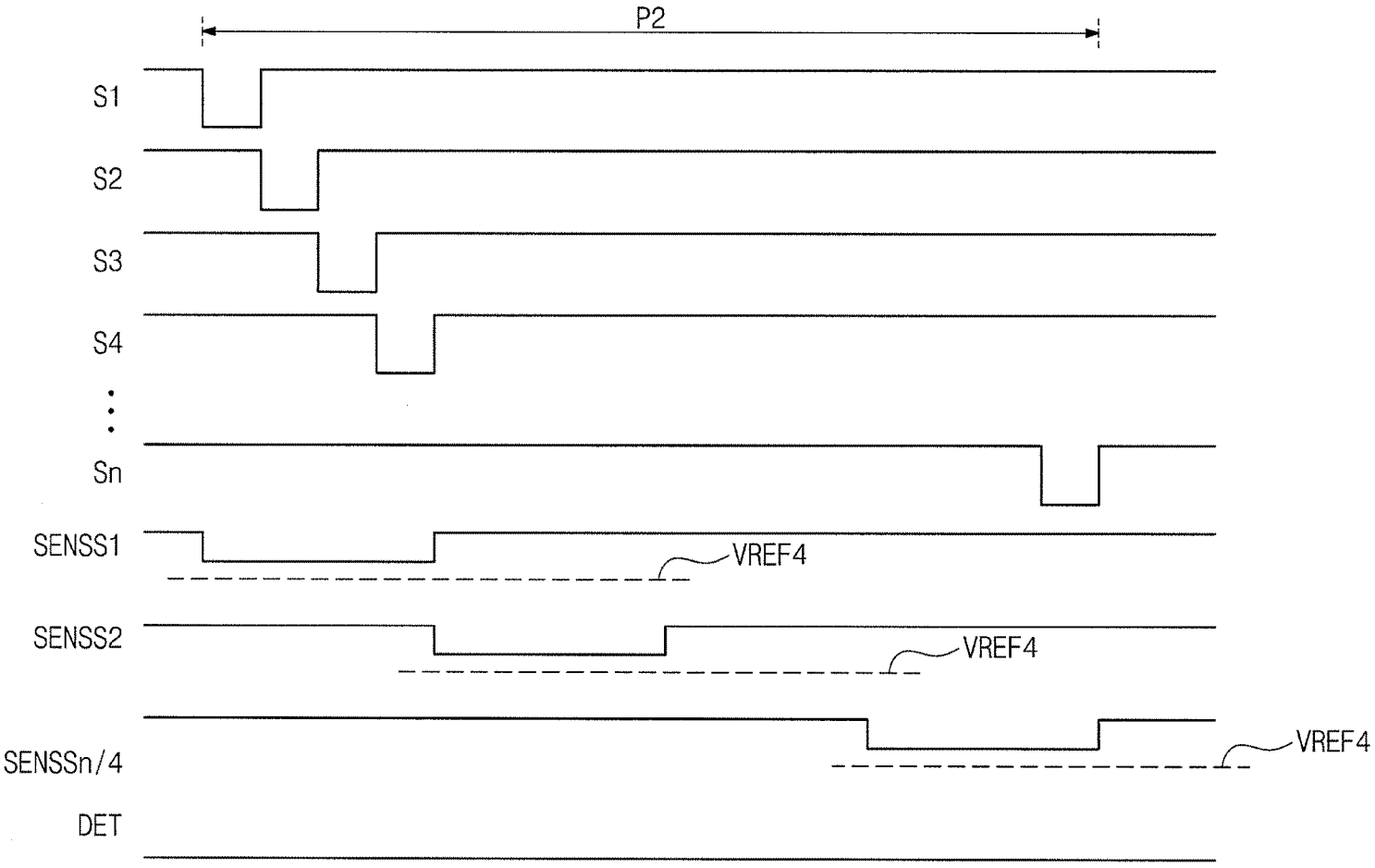
FIG. 13 illustrates a timing diagram of an operation of the error detection circuit illustrated in FIG. 11, according to another embodiment.

FIG. 13 is a timing diagram illustrating an operation of the error detection circuit shown in FIG. 11, according to another embodiment.

Referring to FIGS. 1, 11, and 13, the scan driving circuit 140 provide the scan lines SL1 to SLn with the scan signals S1 to Sn that transition sequentially to a low level during a scan period P2. In response to the fifth control signal CONT5, the error detection circuit 150_3 may detect whether the display panel 110 is damaged, during the scan period P2.

The voltage of the detection signal SENSS1, which is a sum of the scan signals S1, S2, S3, and S4, is maintained higher than the predetermined reference voltage VREF4 when the pixels PX11 to PXnm and the scan lines SL1 to SLn of the display panel 110 are not damaged. Accordingly, the detection signal output circuit 152_3 outputs the error detection signal DET having a low level.

The voltage of the detection signal SENSS1, which is the sum of the scan signals S1, S2, S3, and S4, becomes lower than the predetermined reference voltage VREF4 due to the leakage current when at least one of the pixels connected to the scan lines SL1 to SL4 or the scan lines SL1 to SL4 is damaged. In this case, the detection signal output circuit 152_3 outputs the error detection signal DET having a high level.

When the error detection circuit 150_3 detects the damage of the display panel 110, the pixel PXij illustrated in FIG. 2 may not include the second transistor T2 and the display 110 in FIG. 1 may not include the masking lines ML1 to MLn.

Figure 14:
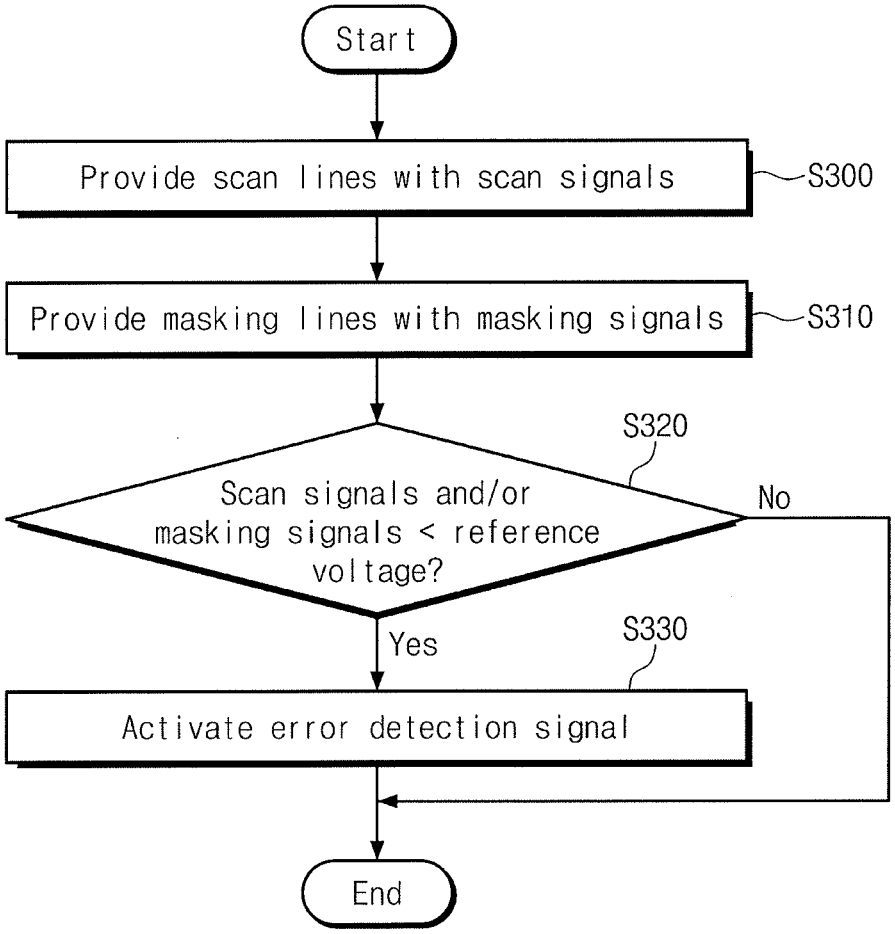
FIG. 14 illustrates a flowchart of an operation of the display device shown in FIG. 1.

FIG. 14 is a flowchart illustrating an operation of the display device illustrated in FIG. 1.

Referring to FIGS. 1, 3 and 14, the scan driving circuit 140 provides the scan lines SL1 to SLn with the scan signals S1 to Sn including test patterns, during the test period Pt (S300). The scan signals S1 to Sn provided for the scan lines SL1 to SLn during the test period Pt may be pulse signals with the predetermined frequency. In other instance, as illustrated in FIG. 12, the scan signals S1 to Sn provided for the scan lines SL1 to SLn during the test period Pt may be pulse signals which are sequentially activated to a low level.

The scan driving circuit 140 provides, during the test period Pt, the masking lines ML1 to MLn with the masking signals Ml to Mn which have voltage levels complementary to voltage levels of the scan signals S1 to Sn (S310). For example, when the i-th scan signal Si transitions to a low level, the i-th masking signal Mi transitions to a high level. Accordingly, even when the scan signal Si transitions to the low level during the light-emitting period P3, the data signal Dj received through the data line DLj may be prevented from being transmitted to the second node N2 in the pixel PXij illustrated in FIG. 2.

The error detection circuit 150 receives the scan signals S1 to Sn transmitted through the scan lines SL 1 to SLn, and the masking signals M1 to Mn transmitted through the masking lines ML 1 to MLn. The error detection circuit 150 compares the scan signals S1 to Sn and the masking signals M1 to Mn with a reference voltage (S320).

For example, as illustrated in FIGS. 4 and 6, the error detection signal DET is activated when the voltage of the sum of the i-th scan signal Si and the i-th masking signal Mi corresponding to each other of the scan signals Si to Sn and the masking signals Mi to Mn is lower than the reference voltage VREF (S330).

Alternatively, as illustrated in FIGS. 7 and 8, the scan driving circuit provides, during the test period Pt, outputs masking signals having the same waveform to the masking lines ML1 to MLn (S310) without supplying scan signals to the scan lines (no S300). The error detection signal DET is activated when the voltage of the sum of i-th masking signal Mi and the (i+1)-th masking signal Mi+1 is lower than a reference voltage VREF2 (S330).

Further alternatively, as illustrated in FIGS. 9 and 10, the scan driving circuit provides, during the test period, scan signals having the same waveform to the scan lines SL1 to SLn (S300) without supplying mask signals (no S310). The error detection signal DET is activated when the voltage of the sum of i-th scan signal Si and the (i+1)-th scan signal Si+1 is lower than a reference voltage VREF3 (S330).

Still further alternatively, as illustrated in FIGS. 11 to 13, the scan driving circuit provides, during the test period or during the scan period, scan signals that sequentially transition to a low level to the scan lines SL1 to SLn (S300) without supplying mask signals (no S310). The error detection signal DET is activated when the sum of four adjacent scan signals in less than a reference voltage VREF4 (S330).

In response to the error detection signal DET having a high level, the signal control circuit 120 may output the third control signal CONT3 such that the power voltage supply circuit 160 does not generate the first power voltage ELVDD and the second power voltage ELVSS. The operation of the display panel 110 is stopped when the power voltage supply circuit 160 does not generate the first power voltage ELVDD and the second power voltage ELVSS. Therefore, the display device 100 is protected against risks such as fire by preventing an overcurrent caused by a short circuit of the signal lines in the display panel 110.

By way of summation and review, according to one or more embodiments, a display device may detect whether a display panel is damaged. According to one or more embodiments, a driving method for the display device may detect whether the display panel is damaged.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated.

Accordingly, it will be understood by those of skill in the art that various changes in form and details may be made without departing from the spirit and scope of the present invention as set forth in the following claims.

What is claimed is:

1. A display device, comprising:

a display panel includes:

a plurality of scan lines to receive scan signals, a plurality of data lines to receive data signals, and a plurality of pixels respectively connected to the plurality of scan lines and the plurality of data lines; and an error detection circuit to receive the scan signals transmitted through the plurality of scan lines, and to output an error detection signal based on the scan signals, wherein power is not supplied to the plurality of pixels when the error detection signal is at an activated level, and wherein the error detection circuit outputs the error detection signal based on the scan signals during light-emitting periods of the plurality of pixels.

2. The display device as claimed in claim 1, further comprising a scan driving circuit to provide the scan signals for the plurality of scan lines, wherein the scan driving circuit is electrically connected to one end of each of the plurality of scan lines, and the error detection circuit is electrically connected to the other end of each of the plurality of scan lines.

3. The display device as claimed in claim 2, wherein the scan driving circuit provides the plurality of scan lines with the scan signals including a test pattern during the light-emitting periods of the plurality of pixels.

4. The display device as claimed in claim 3, wherein the scan signals are a pulse signal with a predetermined frequency during the light-emitting periods of the plurality of pixels.

5. The display device as claimed in claim 3, wherein the scan signals are pulse signals which are sequentially activated during the light-emitting periods of the plurality of pixels.

6. The display device as claimed in claim 5, wherein the error detection circuit compares each of the scan signals with a reference voltage, and activates the error detection signal depending on the comparison result.

7. The display device as claimed in claim 2, wherein the scan driving circuit and the error detection circuit face each other with the display panel therebetween.

8. The display device as claimed in claim 1, wherein the scan signals are pulse signals which are sequentially activated during a scan periods of the plurality of pixels.

9. The display device as claimed in claim 1, further comprising a plurality of masking lines corresponding to and extending parallel to each scan line, wherein the error detection circuit is to receive masking signals transmitted through the plurality of masking lines, and output the error detection signal based on at least one of the scan signals or the masking signals.

10. The display device as claimed in claim 9, wherein each of the masking signals has a level complementary to the level of a corresponding scan signal among the scan signals during the light-emitting periods.

11. The display device as claimed in claim 9, wherein each of the plurality of pixels comprises:

a first transistor connected between a corresponding data line among the plurality of data lines and a first node, and having a gate electrode connected to a corresponding scan signal among the scan signals;

a second transistor connected between the first node and a second node, and having a gate electrode connected to a corresponding masking signal among the masking signals; and a light-emitting circuit to receive a first power voltage and a second power voltage, and to emit light according to a voltage level of the first node.

12. The display device as claimed in claim 11, wherein the light-emitting circuit includes:

a first capacitor connected between the first power voltage and the second node;

a second capacitor connected between the second node and a third node;

a third transistor connected between the first power voltage and a fourth node, and having a gate electrode connected to the third node; and an organic light-emitting diode connected between the fourth node and the second power voltage.

13. The display device as claimed in claim 12, wherein the light-emitting circuit further includes a fourth transistor connected between the third node and the fourth node, and having a gate electrode connected to a compensation signal.

14. The display device as claimed in claim 9, wherein the error detection circuit compares a sum of the scan signal and the masking signal corresponding to each other with a reference voltage, and activates the error detection signal depending on the comparison result.

15. The display device as claimed in claim 9, wherein the error detection circuit outputs the error detection signal based on the masking signals during light-emitting periods of the plurality of pixels.

16. A driving method for a display device including a plurality of pixels connected to scan lines, the driving method comprising:

providing the scan lines with scan signals;

providing masking lines with masking signals according to the scan signals;

comparing at least one of a sum of the scan signals or the masking signals corresponding to each other with a reference voltage; and activating an error detection signal based on the comparison result.

17. The driving method as claimed in claim 16, wherein the scan signals provided for the scan lines are a pulse signal with a predetermined frequency.

18. The driving method as claimed in claim 16, wherein the scan signals provided for the scan lines are sequentially activated.

19. The driving method as claimed in claim 16, further including stopping power supply to the pixels when the error detection signal is activated.

20. A driving method for a display device including a plurality of pixels connected to scan lines, the driving method comprising:

providing the scan lines with scan signals;

dividing the scan signals into a plurality of scan signal groups, comparing a sum of voltages of each of the plurality of scan signal groups with a reference voltage, and activating an error detection signal depending on the comparison result.

* * * * *